United States Patent [19]

Pribnow

[11] 4,414,933

[45] Nov. 15, 1983

[54] COMPRESSION RELEASE MECHANISM USING A BIMETALLIC DISC

[75] Inventor: Gary P. Pribnow, Shorewood, Wis.

[73] Assignee: Briggs & Stratton Corporation, Wauwatosa, Wis.

[21] Appl. No.: 273,474

[22] Filed: Jun. 15, 1981

[51] Int. Cl.[3] ..... F02N 17/00

[52] U.S. Cl. ..... 123/182; 123/180 T; 137/79

[58] Field of Search ..... 123/182, 179 R, 180 T, 123/421, 424; 137/69, 79

[56] References Cited

U.S. PATENT DOCUMENTS

| | | | |
|---|---|---|---|
| 3,417,740 | 12/1968 | Perlewitz | 123/182 |
| 3,804,326 | 4/1974 | McIntire | 123/421 |
| 3,919,991 | 11/1975 | Neschke et al. | 123/182 |
| 4,085,765 | 4/1978 | Nelson | 137/79 |

FOREIGN PATENT DOCUMENTS

| | | | |
|---|---|---|---|
| 1949541 | 10/1970 | Fed. Rep. of Germany | 123/182 |
| 2462265 | 8/1976 | Fed. Rep. of Germany | 137/79 |
| 5741 | of 1909 | United Kingdom | 123/182 |

*Primary Examiner*—Parshotam S. Lall

*Attorney, Agent, or Firm*—Andrus, Sceales, Starke & Sawall

[57] ABSTRACT

A compression release mechanism for facilitating starting of an internal combustion engine includes a bimetallic disc disposed in a passageway that communicates at one end with the combustion chamber of the engine and at its other end with the atmosphere. When the engine is cranked over, the disc is relaxed in an open position so that compression pressure will leak around it to release compression within the cylinder. After the engine fires and begins running, the increase in temperature in the combustion chamber will cause the disc to flex to a closed position which blocks off the passageway to prevent loss of power during normal operation of the engine. The disc will return to its relaxed or open position when the engine is shut off due to the incoming fuel charge cooling the disc so that the passageway is once again open for starting.

5 Claims, 4 Drawing Figures

COMPRESSION RELEASE MECHANISM USING A BIMETALLIC DISC

BACKGROUND OF THE INVENTION

This invention relates to a compression release mechanism for internal combustion engines, and more particularly to an automatic compression release mechanism that is responsive to the temperature in the combustion chamber of the engine.

Compression release mechanisms are frequently used with small gasoline engines, such as those used on lawn mowers, to reduce the manual force required to start the engine and to eliminate the danger of physical injury from kickbacks. The primary concern of such a device is to facilitate starting of the engine without sacrificing the proper choke conditions for starting at cranking speeds and without impairing the normal power performance of the engine at running speeds.

Various arrangements for releasing compression during starting are known in the art. A common type of compression release mechanism is associated with the cam shaft and includes a centrifugal member which, during starting, will hold the exhaust valve open to release compression, and once the engine has started, centrifugal force will act upon the member to permit the valve to operate in a normal manner. Examples of such devices may be found in U.S. Pat. Nos. 3,314,408, 3,620,203, 3,901,199 and 3,981,289. These types of compression release mechanisms, however, require multiple parts that have relatively complicated shapes, or require special tooling and/or modification of the cam shaft for installation.

Another type of compression release mechanism is shown in Roorda, U.S. Pat. No. 3,335,711. The Roorda patent shows a valve that controls compression pressure through a release passage which is connected to the combustion chamber of the engine and is manually opened during cranking and is automatically closed on the first firing stroke of the engine. However, these types of valves require multiple parts, and their manual operation may be overlooked by an operator of the engine.

The prior art also teaches the use of a pair of reed valves as a compression release mechanism in Perlewitz, U.S. Pat. No. 3,417,740, and the use of a small restricted passageway in the cylinder wall which is continuously open in Grisbrook, U.S. Pat. No. 3,040,725. None of these arrangements, however, have been found to solve the problem of providing a reliable compression release mechanism having a minimum number of moving parts.

SUMMARY OF THE INVENTION

The present invention provides an improved compression release mechanism for an internal combustion engine. The mechanism includes a compression release passageway communicating with the combustion chamber of the engine and valve means disposed in the passageway. The valve means is normally in an open position so that compression in the combustion chamber is relieved through the passageway to facilitate engine starting, and is movable to a closed position in response to an increase in temperature in the combustion chamber to block off the passageway to prevent loss of power when the engine fires and begins running.

In one aspect of the invention the valve means includes a flexible valve member in the form of a bimetallic disc. The bimetallic disc will change shape predictably with temperature change, and thus provides a simple, one-piece inexpensive compression release mechanism that is extremely reliable. Such a disc can be readily installed without special tooling and without any modification of the engine cam shaft.

The bimetallic disc is preferably a thin, flat member formed of two strips of metal having different coefficients of heat expansion united throughout their length. The disc preferably extends radially with respect to the compression release passageway, and is held in this position in the passageway by means of a cover bolted to the cylinder head.

The compression release passageway includes a vent hole in a wall of the cylinder head which communicates with a plurality of radial passageways that extend radially beyond the outer edge of the disc. Each radial passage communicates with a chamber formed in the cover which in turn communicates with an outlet hole of a calibrated size in the cover. The cover also provides a seating area for the disc so that when flexed the disc engages and bears against the seating area to effectively seal or close off the compression release passageway. When the engine is cranked over the compression pressure will leak around the bimetallic disc from the inlet hole to the outlet hole via the radial passages and chambers to release compression within the cylinder. After the engine fires several times, the disc will sense an increase in the ambient temperature of the exhaust gases flowing past it from the combustion chamber and will change shape or flex to seat itself against the cover. This blocks off the outlet hole to prevent loss of compression pressure.

The bimetallic disc will remain in the closed position during normal operation of the engine not only because of its flexed shape, but also because the design of the seating area and the various holes and passages of the release passageway cause the compression pressure to act against the disc and help seal the outlet once the disc has changed shape and seated. The bimetallic disc releases or relaxes to its open position when the engine is shut off due to the incoming fuel charge cooling the disc so that the compression release passageway is once again open for starting.

The present invention thus provides a reliable compression release mechanism having only one moving part that is responsive to combustion temperature. The invention eliminates the need for complicated and expensive mechanisms having multiple parts as used in the past.

Other advantages will appear during the course of the following description.

BRIEF DESCRIPTION OF THE DRAWINGS

The drawings illustrate the best mode presently contemplated of carrying out the invention.

In the drawings.

BRIEF DESCRIPTION OF THE PREFERRED EMBODIMENT

Figure 1:
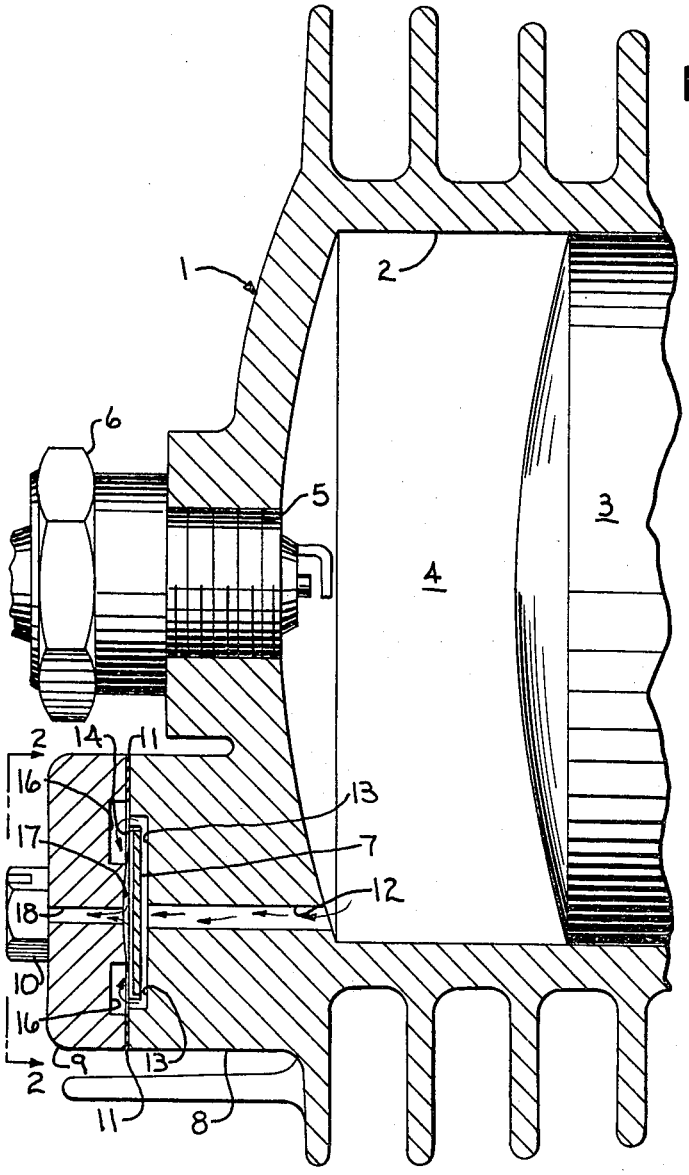
FIG. 1 is a fragmentary view in cross section of a cylinder head of a single cylinder internal combustion engine incorporating a compression release mechanism according to the present invention.

Referring now to the drawings, FIG. 1 illustrates in cross section a portion of a cylinder head 1 of an internal combustion engine. The engine illustrated is a single cylinder, air cooled gasoline engine, having two or four cycles of conventional construction, and is of the type that might be used with lawn mowers, snow blowers or other such machines. Hence, elements of the engine, such as its cam shaft, intake valve, exhaust valve, etc. need not be described in detail. Also, by describing the invention in the embodiment of a simple, single cylinder gasoline engine, the operation of the compression release mechanism of the present invention may be more clearly understood and the invention may thus be readily applied to multi-cylinder or other different designs of internal combustion engines.

As seen in FIG. 1, the cylinder head 1 includes a cylinder 2 that receives a reciprocating piston 3 axially slidable therein and operatively connected to a crank shaft (not shown) in the usual manner. The cylinder head 1 also includes a combustion chamber 4 formed within the cylinder 2 above the piston 3 for receiving an air-fuel mixture in a conventional manner. As used herein the term "combustion chamber" refers to the volume above the piston 3. This volume is variable depending upon whether the piston 3 is in its top dead center position, its bottom dead center position, or somewhere in between these two positions. A threaded bore 5 is formed in the top of the cylinder head 1 and leads to the combustion chamber 4 for receiving a spark plug 6 utilized to ignite the air-fuel mixture.

In accordance with the present invention, the engine shown in FIG. 1 incorporates an automatic compression release mechanism for facilitating starting of the engine. The automatic compression release mechanism acts to release compression in the combustion chamber 4 during the compression stroke of the piston 3 at engine cranking speeds so that the force required to turn over the engine is reduced. However, once the engine fires, the compression release mechanism automatically permits normal operating compression within the combustion chamber 4 so that no loss of power occurs while the engine is running.

The automatic compression release mechanism comprises a compression release passageway communicating at one end with the space within the combustion chamber 4 that is above the reciprocating piston 3 when the piston 3 is at its top dead center position, and at its other end with an area where the pressure is lower than the pressure in the combustion chamber 4 during the compression stroke of the piston 3, and a valve means disposed in the passageway. Preferably, the compression release passageway communicates between the combustion chamber 4 and the atmosphere outside the engine, as seen in FIG. 1.

The valve means preferably comprises a flexible valve member in the form of a bimetallic disc 7. The bimetallic disc 7 is supported in a reinforced portion 8 projecting from cylinder head 1 adjacent the spark plug 6, and is held in position by means of a cover 9 removably secured to the portion 8 by bolts 10. Preferably, a silicone gasket 11 is positioned between the cover 9 and reinforced portion 8 which acts as a seal to prevent loss of compression pressure. The disc 7 is composed of a conventional bimetal material which is available from various sources and is well known in the art. Typically, the disc 7 is formed of two strips of metal having different coefficients of heat expansion and joined throughout their lengths. The thickness of the disc 7 is from about 0.005 inches to about 0.060 inches, and is preferably about 0.020 inches.

Figure 3:
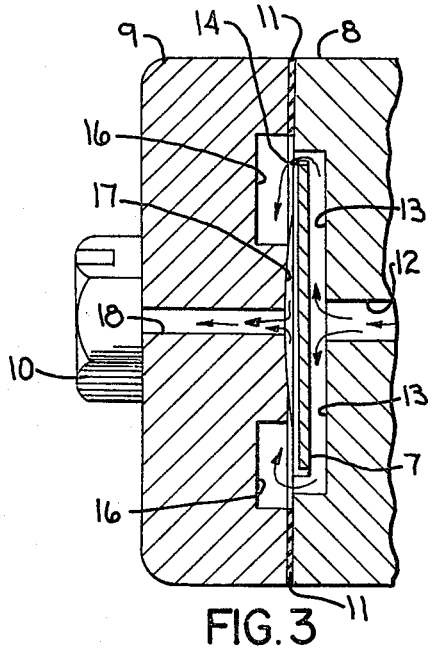
FIG. 3 is an enlarged fragmentary view showing the bimetallic disc of the compression release mechanism relaxed in its normally open position.
Figure 4:
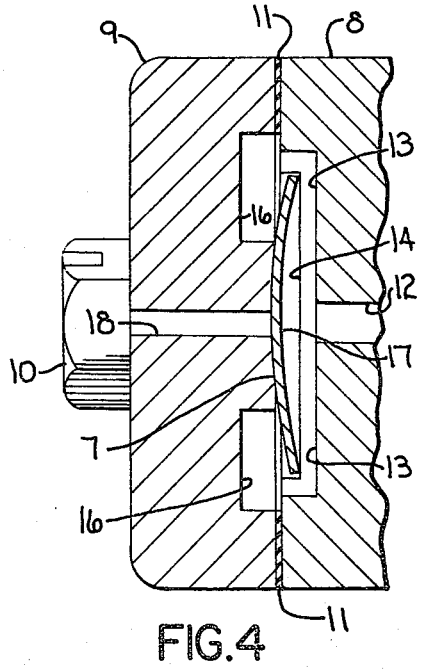
FIG. 4 is an enlarged fragmentary view similar to FIG. 3 showing the bimetallic disc flexed in its closed position.

The bimetallic disc 7 will normally remain relaxed in its unflexed or open position as shown in FIGS. 1 and 3, but will automatically change shape or flex to a closed position in a predictable manner in response to an increase in temperature, such as an increase in combustion temperature in the combustion chamber 4. The increase in the ambient temperature sensed by the disc 7 will cause the disc 7 to bend or flex in the direction of that side of the disc formed of the lower heat expansive metal. The disc 7 is preferably positioned so that its diameter extends radially with respect to the compression release passageway, as shown in FIG. 1. Thus, when the disc 7 flexes it moves to the left as shown in FIGS. 1, 3 and 4. However, it should be noted that the disc 7 may be positioned in other convenient manners to block off the compression release passageway. For example, instead of extending radially with respect to the passageway its diameter could extend parallel with respect to the passageway and in such a position it would flex upwardly or downwardly, as seen in FIG. 1, to block off or close the passageway. Also, as used herein the term "disc" refers not only to a circular member, but also is specifically defined to include members having other geometric shapes, such as square, rectangular or polygonal members.

Figure 2:
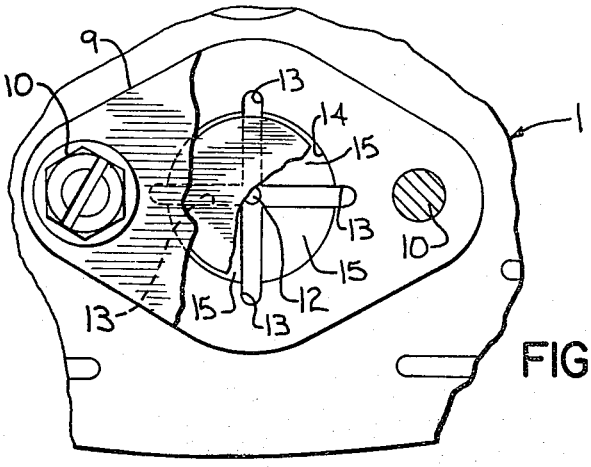
FIG. 2 is a fragmentary view with parts broken away take along the plane of the line 2—2 of FIG. 1.

As shown in FIGS. 1 and 2, the compression release passageway includes a vent hole 12 in the reinforced portion 8 of cylinder head 1. Vent hole 12 has a diameter of from about 1/16 or 0.0625 inches to about ¼ or 0.25 inches and preferably 5/64 or about 0.078 inches. Vent hole 12 opens into the combustion chamber 4 and communicates at one end with the space that is above the reciprocating piston 3 when the piston 3 is at its top dead center position. As seen in FIG. 1, the axis of vent hole 12 is parallel to the axis of piston 3. However, as is readily apparent, vent hole 12 may be positioned in other manners and the present invention is thus not limited to having the vent hole 12 parallel to the piston axis.

As seen in FIG. 2, the other end of vent hole 12 communicates with four radial channels or passages 13. The passages 13 are formed in the reinforced portion 8 of cylinder head 1 and extend radially from vent hole 12 to a point beyond the circumference of disc 7. The radial extent of passages 13 thus permit compression pressure to leak around the disc member 7. Radial passages 13 are disposed ninety degrees with respect to one another, as seen in FIG. 2. However, it is readily apparent to those skilled in the art that the radially passage 13 may be disposed at other angles with respect to one another and that there need not necessarily be four passages 13, but instead there may be any number as desired.

As seen best in FIG. 2, the disc member 7 sits in a circular recessed portion 14 formed above the radial passages 14 in the reinforced portion of head 1. This recessed portion 14 communicates with the radial passages 13 and thus the passages 13 are channel-shaped. The passages 13 also form four landings 15 therebetween which support the disc member 7. It should be noted that although the recessed portion 14 is circular, as shown in FIG. 2, other geometric shapes may also be used to correspond to member 7 depending upon the shape of member 7.

As seen best in FIGS. 3 and 4, each radial passage 13 communicates with a chamber 16 formed in the cover 9, and each chamber 16 communicates via a seating area 17 with an outlet hole 18 formed in cover 9. Outlet hole 18 is coaxial with vent hole 12 and of a calibrated size which is preferably smaller than vent hole 12. Thus, outlet hole 18 has a diameter from about 0.020 inches to about 0.090 inches and preferably about 0.050 inches.

Seating area 17 is formed on the underside surface of cover 9 and is dish-shaped to substantially conform with the shape of disc member 7 when disc member 7 is flexed, as shown in FIG. 4. The radially inner end of seating area 17 communicates with outlet hole 18 and the radially outer end communicates with each chamber 16. The clearance between the radially outer end of seating area 17 and disc member 7 is from about 0.003 inches to about 0.020 inches and preferably about 0.010 inches. It should be noted that if the diameter of disc member 7 is varied, the seating area 17 should be compensated accordingly to ensure that seating area 17 and disc member 7 substantially conform to one another when disc member 7 is in its flexed condition. Also if the thickness of disc member 7 is varied, the clearance between the radially outer end of seating area 17 and disc member 7 must also be adjusted to ensure a sufficient restriction for the flow of compression pressure.

In operation, when piston 3 is starting its ascent and the engine is being manually cranked for starting, compression pressure within combustion chamber 4 will be at a minimum and equal to atmospheric pressure. At this point in time, disc member 7 is relaxed in its normally unflexed or open position, as shown in FIG. 3. As piston 3 ascends toward top dead center on its compression stroke, the pressure of the fuel-air mixture in the combustion chamber 4 rises above atmospheric pressure due to the calibrated size of the compression release passageway thereby creating a differential which causes the fuel-air mixture to flow from combustion chamber 4 into vent hole 12, radial passages 13, chambers 16 and outlet hole 18. Thus, compression pressure will leak around the bimetallic disc 7 via the compression release passageway when the engine is cranked over cold. Under these conditions, the bimetallic disc member 7 will remain in its relaxed state in its open position so that compression in the combustion chamber 4 is relieved to reduce cranking effort and thus facilitate starting.

When the engine fires several times, the bimetallic disc member 7 will be exposed to the rapidly increasing combustion temperature within cylinder 2 which will cause it to automatically change shape and flex to its closed position to shut off or block the outlet hole 18, as shown in FIG. 4. In its closed position, the bimetallic disc member 7 substantially conforms to the shape of the seating area 17 of cover 9, and thus closes the clearance at the radially outer end of seating area 17. As can be seen in FIG. 4, the design of the seating area 17, vent hole 12 and radial passages 13 cause the combustion pressure within chamber 4 to act against the bimetallic disc member 7 and help it engage and bear against seating area 17 to seal outlet hole 18 once the disc 7 has changed shape and seated. Under these conditions, the bimetallic disc member 7 remains seated in its closed position during normal operation of the engine so that loss of power does not occur.

The bimetallic disc member 7 releases and returns to its normally relaxed or open position when the engine is shut off due to the drop in temperature of the gases in combustion chamber 4. This drop in temperature results from the incoming fuel charge cooling the gases in chamber 4 and from the cooling effect of the ambient air on the engine. After the engine has been working and is thoroughly hot, the temperature in chamber 4 drops sufficiently in about 10 seconds to three minutes so that the bimetallic disc member 7 will return to its normally relaxed state. The compression release passageway is then once again open for starting purposes.

Although vent hole 12 is shown and described as communicating with the combustion chamber 4 above the top dead center position of piston 3, it may also communicate through a side wall of cylinder head 1 with the combustion chamber 4 at a point below the piston's top dead center position. At such a location, the piston 3 would actually close off vent hole 12 during the compression stroke.

A preferred embodiment of a compression release mechanism has been illustrated and described herein. Such mechanism comprises a compression release passageway and a bimetallic disc member disposed therein. The disc member is normally relaxed in an open position so that compression in the combustion chamber is relieved through the passageway during starting, and automatically flexible to a closed position in response to an increase in combustion temperature to block off the passageway during engine running. Although described in relation to a single cylinder gasoline engine, the compression release mechanism of the present invention may be utilized with other reciprocating piston-type engines. In addition, although the present invention preferably utilizes a disc member composed of bimetal material it is readily apparent to those skilled in the art that other types of valve means may also be utilized that are responsive to combustion temperature changes.

Various modes of carrying out the invention are contemplated as being within the scope of the following claims, particularly pointing out and distinctly claiming the subject matter which is regarded as the invention.

I claim:

1. An automatic compression relief valve means for facilitating starting of an internal combustion engine of the type having a combustion chamber associated with a cylinder within a cylinder head and a piston having a compression stroke within said cylinder, comprising:

a housing member having a circular recess formed in its outer surface, said housing member including a centrally located inlet vent hole communicating between said recess and said combustion chamber;

a cover member having a cavity formed in its outer surface, said cover member including a centrally located outlet hole communicating between said cavity and the outer atmosphere, said cover member removably secured to said housing member for enclosing said recess so that said cavity and recess provide a disc-receiving chamber;

said housing member further including a plurality of lands located at the bottom of said recess, said lands define a plurality of equiangularly spaced apart channels that extend radially from said inlet hole to a point beyond the circumference of said recess for providing fluid communication between said inlet hole and said cavity, said inlet hole, channels, cavity and outlet hole defining a compression release pasageway, a thin, flexible disc member disposed in said chamber, said disc member normally relaxed in an open position supported by said lands so that compression in said combustion chamber is releived through said passageway during engine starting and automatically flexible to a closed position overlying said outlet hole in response to an increase in the temperature in said combustion chamber to block off said passageway during engine running.

2. The relief valve means of claim 1, wherein said disc member is bimetallic.

3. The relief valve means of claim 1, wherein said inlet and outlet holes are coaxially positioned with respect to one another.

4. The relief valve means of claim 1, wherein said cover member includes a seat formed in said cavity having a dish-shaped surface that conforms to the shape of said disc member when flexed so that said disc member is in sealed contact overlying the outlet hole when in its closed position.

5. The relief valve means of claim 1, wherein said outlet hole has a cross sectional area which is less than the cross sectional area of said inlet hole.

* * * * *